United States Patent [19]

Wenner

[11] Patent Number: 4,591,042

[45] Date of Patent: May 27, 1986

[54] COIN MACHINE FOR A NEWSPAPER, MAGAZINE, FOOD OR OTHER ITEM DISPENSING APPARATUS

[76] Inventor: Hans Wenner, Im Emmertsgrund 13, 6900 Heidelberg, Fed. Rep. of Germany

[21] Appl. No.: 372,548

[22] Filed: Apr. 28, 1982

[51] Int. Cl.[4] ..... G07F 5/06

[52] U.S. Cl. ..... 194/225; 194/286; 194/320; 194/338; 194/344

[58] Field of Search ..... 194/1 G, 1 D, 1 K, 92, 194/93, DIG. 2, DIG. 29

[56] References Cited

U.S. PATENT DOCUMENTS

| | | | |
|---|---|---|---|
| 1,403,933 | 1/1922 | Barson | 194/92 |
| 2,040,983 | 5/1936 | Du Grenier | 194/1 G X |
| 2,170,270 | 8/1939 | Thatcher | 194/DIG. 2 |
| 3,159,262 | 12/1964 | Vaccaro et al. | 194/92 X |
| 3,174,608 | 3/1965 | Knickerbocker | 194/54 |
| 3,265,177 | 8/1966 | Knickerbocker | 194/54 |
| 3,464,530 | 8/1969 | Knickerbocker | 194/71 |
| 3,738,466 | 6/1973 | Knickerbocker | 194/18 |
| 3,882,984 | 5/1975 | Knickerbocker | 194/94 |
| 3,946,848 | 4/1976 | Knickerbocker | 194/94 |
| 4,000,799 | 1/1977 | Knickerbocker | 194/1 L |
| 4,037,701 | 7/1977 | Knickerbocker | 194/1 L |
| 4,375,255 | 3/1983 | Roberts | 194/1 G |

FOREIGN PATENT DOCUMENTS

| | | |
|---|---|---|
| 1957092 | 3/1971 | Fed. Rep. of Germany . |
| 2350257 | 10/1974 | Fed. Rep. of Germany . |
| 2510584 | 9/1976 | Fed. Rep. of Germany . |
| 2557880 | 7/1977 | Fed. Rep. of Germany . |
| 0017063 | 3/1980 | Fed. Rep. of Germany . |

*Primary Examiner*—F. J. Bartuska
*Attorney, Agent, or Firm*—Staas & Halsey

[57] ABSTRACT

A coin machine for collection and checking of different types of coins and for release of a device for dispensing goods when the proper number of coins for the item purchase price is inserted into the coin machine. The coin-checking device comprises a carrier plate arranged vertically between a housing front and back wall, wherein at least on one side of the carrier plate there is located parallel thereto a coin-checking plate which can be tilted. Adjacent to the coin-checking plate there is located parallel to the carrier plate a coin-channel plate which is fitted with inclined slots, through which extend angular protrusions of a lower plate and which form the bottom of the running channels for the coins. The coin-channel plate is also parallel to the carrier plate and can also be swiveled. Furthermore, there is provided a sensing and blocking mechanism consisting of a plurality of hinged, vertically mounted, spring-loaded levers which have attached bolts at their lower ends, the bolts extending through the inclined slots of the coin-channel plate, and which act on a blocking lever for releasing or locking a control bar which, in turn, controls the opening action of the dispensing plate of the coin machine. Depending on whether the levers sense or do not sense coins in the coin channels, the dispensing flap of the coin machine is controlled to be opened or closed.

16 Claims, 8 Drawing Figures

COIN MACHINE FOR A NEWSPAPER, MAGAZINE, FOOD OR OTHER ITEM DISPENSING APPARATUS

BACKGROUND OF THE INVENTION

The invention relates to a coin machine for a newspaper, journal, food or other item dispensing apparatus. The coin machine comprises a housing with a front and a back wall and a coin mechanism for receiving and checking different coins and for releasing the machine when the correct coins for the item purchase price have been inserted or for returning the coins if the machine is blocked.

German Utility Pat. [Gebrauchsmuster] No. 7,102,288 teaches a coin machine for newspaper and magazine dispensing apparatus which has a coin mechanism consisting of a funnel and having several coin conduits. A rotary knob is mounted on a shaft. This knob is connected to rotatable catch levers on shaft gears with recesses. The mechanism also has a connecting pin connected to an angular rod for releasing the coins into a coin box. This known coin machine also has a release mechanism consisting of an elastic traction cable with cable guide, transport shaft and a knee lever.

The above-known coin machine is not sufficient for coins of different values and is usually intended for only two different coins. Furthermore, such a coin machine is not equally suitable for all coin machines. In addition, the known coin machine does not have an absolutely reliable blocking device for blocking the coin machine if counterfeit coins are inserted, or if the coins inserted do not equal the item purchase price.

SUMMARY OF THE INVENTION

It is a primary object of the invention to eliminte the problems in conventional coin machines. A specific object of this invention is to provide a coin machine of the type initially described which is able to take a large number of different kinds of coins, whereby the machine can distinguish over the various coins, e.g., recognize two 0.05 DM coins as one 0.10 DM coin. In addition, it is an object of this invention to provide a coin machine having a completely reliable blocking device against counterfeit coins and unauthorized removals, whereby the recognition should be purely mechanical. Finally, it is an object of this invention to provide a coin machine which is small and therefore capable of being placed in many coin machines for dispensing different kinds of items.

To achieve the foregoing objects and in accordance with the purpose of the invention, there is provided a coin machine for item dispensing apparatus with the following combination:

(a) a coin mechanism consisting of a carrier plate which runs vertically from a housing front wall to a housing back wall, on which plate at least one coin checking plate is located so that it can pivot in a plane-parallel fashion, with coin collection conduits and a scanning and blocking mechanism for holding and releasing the coins inserted.

(b) The coin checking plate is directly followed by a coin conduit plate parallel to the carrier plate. This coin conduit plate has inclined slots through which project the inclined bends of a lower plate which form the bottom for the coins. This lower plate is also parallel to the carrier plate and can pivot about an axis for pivoting the bends out of the inclined slots of the coin conduit plate.

(c) A scanning and blocking mechanism consisting of a plurality of pivotable and vertically arranged, spring-loaded levers which have bolts on their lower ends which extend through the inclined slots of the coin conduit plate and which are operatively connected to a catch lever for releasing or blocking a control strip which regulates the opening function of the dispensing flap of the coin machine.

In another embodiment of a coin machine in accordance with the invention there is provided the following construction:

(a) A coin machine consisting of a housing having a front wall to which is fastened obliquely running coin checking strips which are at an interval from each other, positioned above each other and which form intermediate guide conduits.

(b) Coin conduit strips located vertically and at an interval from each other on the front wall, forming intermediate coin-collection conduits which lead on their upper ends to the guide conduits.

(c) Latches extending into the conduits in the vicinity of the transition of the inclined guide conduits to the vertical coin collection conduits. The latches are fastened to a blocking mechanism.

(d) The blocking mechanism is operatively connected to an actuating shaft for releasing or not releasing the goods to be dispensed.

(e) A plate which contacts the coin checking strips and the coin conduit strips is pivotably located in front of the front wall.

Other embodiments of the invention are included herewith and can be ascertained from the drawings, detailed description of the invention and the claims set forth hereinafter.

The coin machine of the invention has the advantage that it can take a plurality fo coins of different values, whereby any desired distinction between the coins can be made. For example, two 0.50 DM coins can be recognized and stored as a 1.00 DM coin. Likewise, the coin machine of the invention has a completely reliable blocking device against counterfeit coins and unauthorized removals, including when the machine is opened for restocking by servicemen. In addition, the coin mechanism of this invention is narrow and small, for which reason it can be used in many coin machines for different kinds of goods to be dispensed. This narrow construction for the coin mechanism is achieved in particular by virtue of the fact that in order to be checked, the coins roll from the front wall to the back wall and then to collection in coin collection conduits or to return over a coin return from the back wall back to the front wall. In the first above-described embodiment of the invention, a return conduit to the coin return container can be dispensed with. Moreover, the scanning and blocking mechanism is considerably simplified and is freer from errors. In addition, the coin recognition is performed mechanically, thus eliminating the need for expensive and troublesome electronic components.

DETAILED DESCRIPTION OF THE PREFERRED EMBODIMENTS

Figure 1:
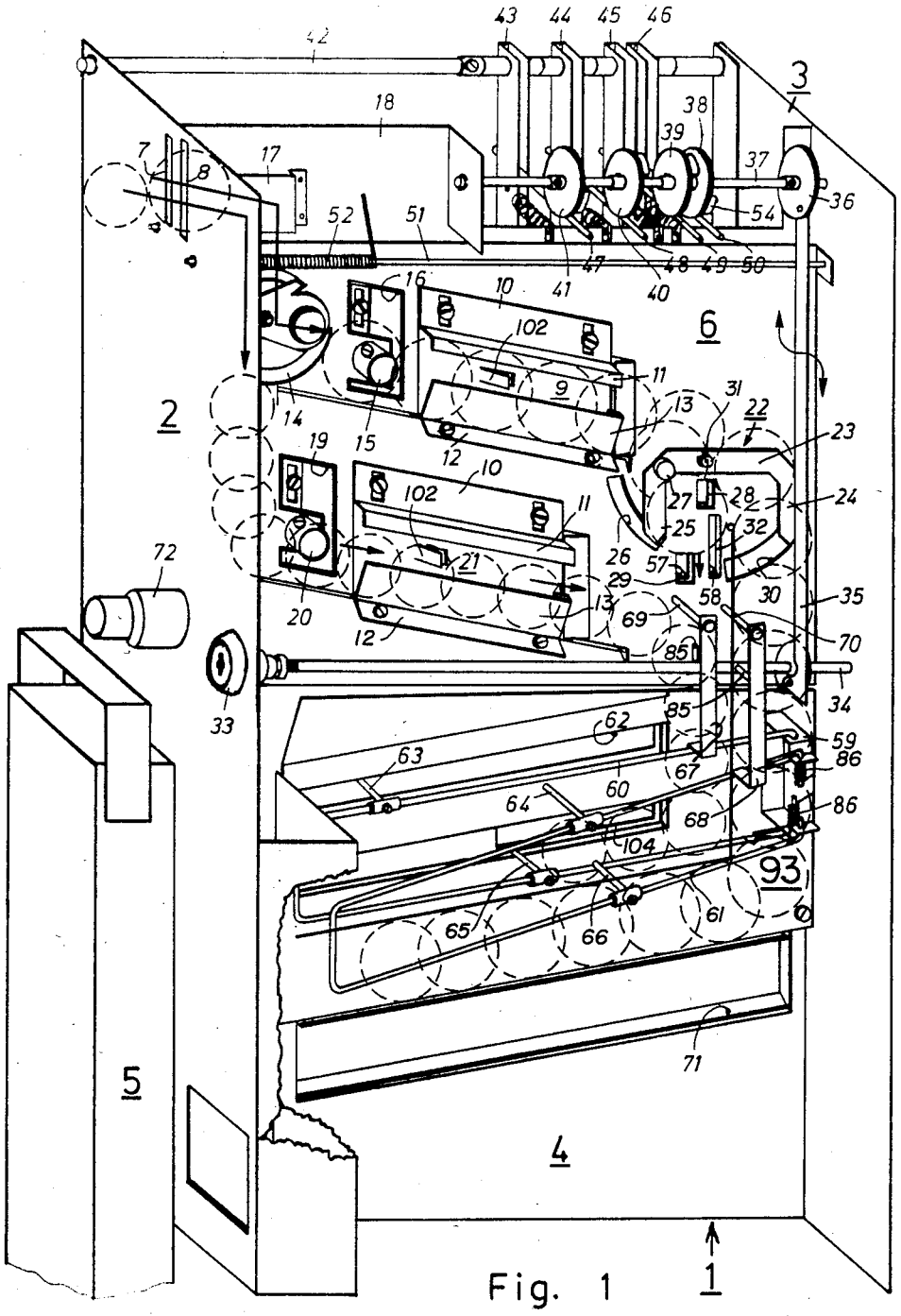
FIG. 1 shows a perspective view of the coin mechanism of the coin machine in accordance with the invention, illustrating the front wall and the right side of the carrier plate along with the other plates mounted on it.
Figure 2:
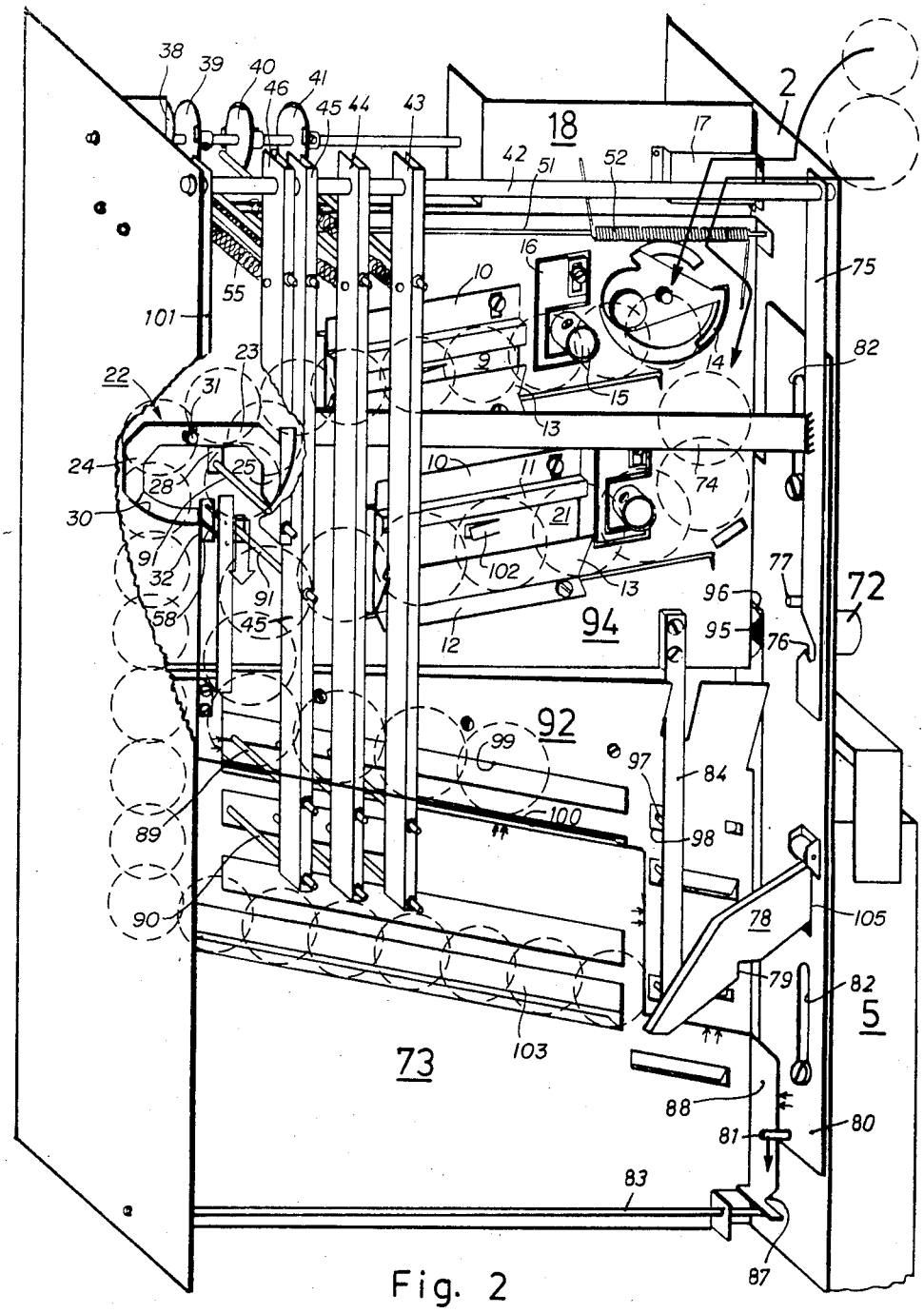
FIG. 2 is a perspective view of the coin mechanism of FIG. 1, illustrating the left side of the carrier plate along with the other plates mounted on it and further illustrating the scanning and blocking mechanism of the coin machine.
Figure 5:
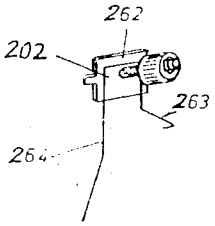
FIG. 5 is another example of a rocker for expanding the possibilities of insertion of two different coin types with a short lever and a long lever. This rocker corresponds in its function to the rocker shown in FIG. 1.
Figure 6:
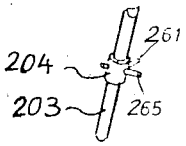
FIG. 6 is a partial view of a guide rod with an adjustment bushing which slides on it and the bushing holding bolt.
Figure 4:
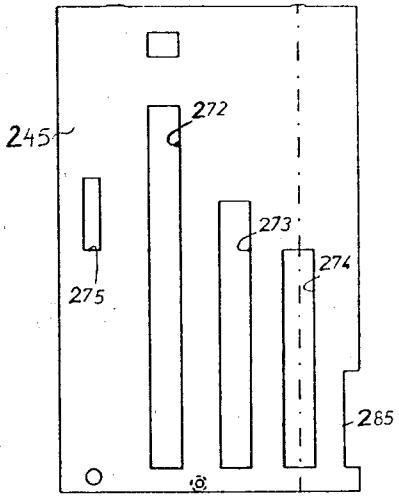
FIG. 4 is a top view of the coin conduit plate with the openings in it.

The coin mechanism or coin checking device of a coin machine shown by way of example in FIG. 1 and 2 consists of a housing 1 which has a narrow front wall 2 and back wall 3. A carrier plate 4 is located inside housing 1 and is fixed vertically and centrally between front wall 2 and back wall 3. Carrier plate 4 can have a series of openings and slots, e.g., an inclined slot 71 for coin return. A handle 5 pivotable about a lower axle (not shown) is located on front wall 2. A spiral spring for placing handle 5 back into position can be located on the axle. To the left and the right of carrier plate 4, the front wall has an insertion slot 7, 8 for various coins in its upper area. Each insertion slot 7, 8 is for at least two different coins. A return knob 72 and a lock 33 are also located on the front wall. Adjusting the cylinder lock causes a switching over to different values of coins, which will be described in greater detail hereafter.

A coin checking plate 6, 94 is located on the right and on the left side, respectively, of carrier plate 4 in its upper half. These checking plates function in essentially the same manner. Each coin checking plate has at least two coin checking devices, each one for a coin value.

A coin distributor device 14, as known in the art, is at the entrance of the coin checking path, and decides to which coin-checking device 9, 21 the inserted coin between the coin distributor device 14 and the respective coin-checking devices 9, 21 are located corresponding coin positioning components 15, 16 and 19, 20, respectively. Each of the coin-checking devices consists, for example, of an obliquely positioned upper guide sheet 10 which has a bent-down outer edge 11, and of a lower guide sheet 12 which is inclined in the same manner and also has a bent outer edge 13 which extends over the bent-back outer edge 11 of the upper guide sheet 10. If a coin runs into this checking device, it must pass a projecting lug 102 which tries to press the coin outward. If the coin is too small, its upper edge does not run within the bent-down outer edge 11, but rather falls onto the bent outer edge 13 of guide sheet 12 and is ejected via the return. If, on the other hand, the coin is of the proper size, its upper edge runs within the bent-down outer edge 11 of the upper guide sheet 10 and the coin moves on to further processing into a coin collection conduit as described hereinafter.

The right-side coin checking plate 6 (and similarly the left-side coin checking plate 94) also has a number of slots 26, 28, 29, 30 and 32, whereby slots 26 and 30 are curved. A rocker 22 is pivotably mounted on a rotary axle 31 and consists of a horizontal lever 23 and two arms 24, 25 which extend vertically downward. Pins are located at the ends of the arms 24, 25, which pins run in slots 26, 30. Rocker 22 catches the first of two inserted coins associated with upper coin checking device 9. For example, they could be coins with a value of DM 0.05 or DM 0.50, which yield the corresponding double value when added. The first coin runs into the rocker 22 and is held back in it by sensor bolt 57 or 58 and by the vertically downward-extending arm 25 of rocker 22. The second coin of the same value or denomination runs over the first coin and releases the first coin by pivoting downwardly the back vertical lever arm, i.e., the vertically downward-extending arm 24, thus pivoting upwardly the arm 25. This means that the coin which was inserted first and retained in rocker 22 can fall into an associated sensored coin collection conduit (see, e.g., the right-side conduit formed by slot 104 in FIG. 1, or the left-side conduit formed by slot 100 in FIG. 2). The second of the coins inserted of the same value and running over the first coin falls into a reserve coin collection conduit not engaged by sensor bolt levers 43 to 46 (see, e.g., the left-side conduit 103 in plate 92 of FIG. 2).

Rocker 22 can be constructed in such a manner that vertically downwardly-extending arms 24, 25 have different lengths in order to assure an optimum functioning of the rocker. The longer of the two vertically downwardly-extending arms, which is functionally associated with the last-inserted coin of the same value or denomination, can pass or extend the last-inserted coin into the unsensored or reserve conduit.

As best seen in FIG. 1, a lock 33 is accessible from the front wall 2, the lock cylinder of which is connected to a round rod 34 suitably mounted inside the housing 1. Round rod 34 is connected to one end of a strip 35, whereby the rotary movement of the round rod 34 is converted into a back-and-forth movement of joining strip 35. Joining strip 35 is connected at its other end to a disk 35 mounted on an axle 37 which is rotatably mounted at one end in back wall 3 and at the other end in an angular piece 18 fastened internally to front wall 2. A series of disks, preferably round disks 38, 29, 40 and 41, are permanently fixed to axle 37, so that when round rod 34 is rotated, round disks 38, 39, 40, 41 can be turned. Each of the disks has at least one cam 54 for stopping a respective lever 43, 44, 45, 46 via corresponding blocking rods 47, 48,49, 50 located thereon.

Round rod 42 is rotatably mounted between the front wall 2 and the back wall 3. Levers 43, 44, 45 and 46 are suspended to rod 42 by their upper ends and are called sensor bolt levers herein. These sensor bolt levers 43, 44, 45 and 46 have corresponding blocking rods 47, 48, 49, 50 in the vicinity of the respective round disks 41, 40, 39, 38, which blocking rods cooperate with cams 54 of the corresponding round disks in such a manner that, at a certain position of the round disks and thus of the cams, the sensor bolt levers 43–46 are stopped. The sensor bolt levers are held by respective traction springs 55 (FIG. 2) in a preferred position, namely in the direction of carrier plate 4. Each of coin checking plates 6 and 94 is held so that the plate can pivot about a round rod 51 which is rotatably mounted in the front and back walls 2 and 3, is pressed by a return spring 52 into a preferred position, preferably in the direction of the carrier plate 4. While the description above has generally been made with reference to the components for coin checking plate 6, coin checking plate 94 has similar components which are identified in the drawings, particularly FIG. 2, with the same reference numerals as for coin checking plate 6.

In accordance with the preferred embodiment of this invention, a coin conduit plate 93 adjoins coin checking plate 6 in order to continue the coin path, and a coin conduit plate 92 adjoins checking plate 94. Each of these two coin conduit plates 92, 93 has a series of inclined slots. Plate 92 has slots 99, 100 and 103 and plate 93 has slots 62 and 104 and a slot analogous to slot 103 but not shown. Bends or angular protrusions, which extend through slots 100, 103, 104, and the slot analogous to slot 103 but not shown, are located on a lower plate 73 (FIG. 2) and project out of the plate plane through the respective slots of coin conduit plates 92 and 93. These bends or angular protrusions thus form the floors of two left-side and two right-side coin conduits and the side walls of the coin conduits are formed by the opposing coin conduit plates 92, 93 and the carrier plate 4. The contour of plate 73 in FIG. 2 is marked by small double arrows for better distinction. FIG. 2 also shows that plate 73 therefore partially covers coin conduit plate 92. Thus, in FIG. 2 the protrusions of plate 73 extend from the left toward the right of the coin machine, i.e., out of the plane of the drawing through the slots of coin conduit plate 92, through perfectly congruent slots within carrier plate 4 and through congruent slots within coin conduit plate 93 on the other or right side of carrier plate 4. Thus, the coin collection conduits no longer run vertically, but are inclined from the back wall to the front wall. This arrangement saves a considerable amount of space, as an additional return conduit to the coin return container can be omitted. FIG. 2 also shows that lower plate 73 is mounted so that it can pivot about on axle 83 mounted at the front wall 2 and the back wall 3 of the housing. Plate 73 is likewise held in a preferred position toward carrier plate 4.

A plurality of wire frames 60, 61 mounted on support bracket 59 serve to set different coin values. The example, described herein and in the drawings (FIG. 2), has two frames preferably made of a bent metal wire and which are rotatably mounted at support bracket 59. A plurality of coin holder bolts 63, 64, 65, 66 are shiftably located on frames 60, 61 and can be stopped and held at any spot by means of holding screws. The coin-holder bolts hold the coins in the coin collection conduits described earlier after they have been inserted. Each of the two wire frames 60, 61 is associated with the two coin collection conduits, one on each side of carrier plate 4. That is, frame 60 has coin holder bolts 63 and 65 for the respective left-side and right-side coin sensored collection conduits formed by slots 99 and 104 and frame 61 has coin holder bolts 64 and 66 for the same respective left-side and right-side coin sensored collection conduits formed by slots 99 and 104. When lock 33 is actuated, frames 60, 61 are pivoted alternately toward carrier plate 4 or away from it via respective frame elements 67 and 68 engaging or not engaging spacing bolts 85 which are located in a staggered pattern on round rod 34 and against return springs 86 of frames 60, 61. Return springs 86 press the associated frame in the direction of the carrier plate. In this way a key can be used to switch from one purchase price to another for the item to be dispensed, whereby round rod 34 is simply turned via the cylinder lock.

Sensor bolt levers 43, 44, 45, 46 have various sensor bolts 89, 90, 91 on their lower ends. Bolts 89 and 60 extend through the conduit slots of coin conduit plates 92, 93 and lower plate 73 to sense coins present in the left-side and right-side coin sensored collection conduits (i.e., the bolt 89 sensing coins in the left-side coin collection conduit formed by the angular projection and slot 99, and the bolt 90 sensing coins in the right-side coin collection conduit formed by the angular projection and slot 104). As can be seen from FIG. 2, coins in the left-side conduit formed by the angular projection and slot 103 are not sensored by sensor bolts (and also to the analogous right-side conduit formed by an angular projection and slot corresponding to slot 103 but not shown in FIG. 1). When levers 43 to 46 are pivoted about round rod 42, sensor bolts 89, 90 are pivoted respectively out of the path into the path of the coins. The sensor bolts which are not needed for certain item purchase price settings are blocked by retaining the particular sensor bolt lever 43–46. This retention is accomplished by use of blocking round rods 47, 48, 49, 50 by means of the cams 54 on round disks 38, 39, 40, 41. In this way, a sensor bolt lever can be blocked or freed when a certain item purchase price is set.

The scanning and blocking mechanism of the coin machine further comprises a bent metal frame piece 75, as best seen in FIG. 2, which can pivot on round rod 42 and which points downward. This frame piece 75 has a cross-traverse member 74 which is rigidly connected to a second bent metal frame piece 101 which is pivotally mounted on round rod 42. Thus, the two pieces 75 and 101 are connected rigidly together over traverse member 74. Sensor bolt levers 43 to 46 lie on cross traverse member 74 and can be carried along by it, so that coin sensor bolts 89, 90 are pivoted out of the oblique slots of the coin conduit plates 92, 93 and the lower plate 73.

A control strip 80 is vertically positioned on the inner side of the front wall and can be shifted up and down the length of longitudinal holes 82. Control strip 80 has a guide bolt 77 which cooperates with an outwardly opening notch 76 formed in the frame piece 75 as shown in FIG. 2. Control strip 80 also has a lower guide bolt 81 which cooperates with an inclined edge of lower plate 73 or with an outwardly opening notch 87 in an edge of lower plate 73. Control strip 80 also has a slot 105 through which a lever 78 extends, the lever 78 in turn being fastened to the handle 5.

If handle 5 is folded up, as in FIG. 2, or if the coin checking device is closed guide bolt 77 presses the bent metal frame piece 75 outward, which in turn causes sensor bolt levers 43 to 46 to pivot out over cross traverse member 74 away from the carrier plate 4 counter to the pull of tension springs 55. If the coin checking device is actuated by handle 5 being pulled out, control strip 80 is pressed downward by the downwardly inclined lever 78. This causes guide bolt 77 to move into the range of notch 76 in bent metal piece 75. Now sensor bolt levers 43 to 46 are freed, namely in the range of notch 76, and move inwardly toward carrier plate 4. If the required coins are now in the left-side and right-side coin sensored collection conduits, sensor bolts 89, 90 are prevented from penetrating into the coin collection conduit slots and sensor guide bolt 77 passes notch 76 without engaging notch 73. Handle 5 can now be turned further down.

Lower guide bolt 81 cooperates with the oblique edge of the angular sides 88 of plate 73 at notch 87 in another position of control strip 80, which causes lower plate 73 to pivot against the force of its return spring about axle 83. This causes the angular protrusions of lower plate 73 which extend through the slots of coin conduit plates 92, 93 to be pivoted away too. In doing so, the coins fall from all of the coin conduits into a coin storage collector.

If, however, one of the required coins is missing from the left-side or right-side coin sensored collection conduits, the corresponding sensor bolt on the sensor bolt lever 43, 44, 45 or 46 penetrates through the inclined slot into the coin collection conduit, which causes the corresponding sensor bolt lever to pivot bent metal piece 75 over cross member 74 in the direction of carrier plate 4. This causes guide bolt 77 to enter into notch 76 in bent metal piece 75, thus checking the downward movement of control strip 80. In this manner, lever 78 on handle 5 is prevented from moving further out by control strip 80.

If, on the other hand, handle 5 was drawn out, control strip 80 is pressed upward again during the opposite movement by the upper edge of oblique lever 78, which causes guide bolt 77 to press bent metal piece 75 outward again. This also causes sensor belt levers 43 to 46 to be pivoted out away from carrier plate 4.

Control strip 80 also has a shoulder 96 which ends in the immediate vicinity of return knob 72. Return knob 72 has an inclined surface, for example, in the inside which cooperates vertically with the edge of coin checking plate 94. The return knob is conically shaped on its back end. If the customer desires his coins back after they have been inserted, return knob 72 is pressed in, which causes the oblique surfaces of the return knob to press the two coin-checking plates 92, 93 away from the carrier plate 4. A pivoted lever 84 positioned vertically downwardly on coin checking plate 94 has various coin blocking bolts 97 which extend through notches 98 in coin conduit plate 92. Coin-blocking bolt 97 and the set frames 60 or 61 are simultaneously pivoted with the corresponding holding bolts out of the vicinity of the coin collection conduits. All coins which are in the coin collection conduits or the coin checking devices are grasped by the rockers now run via the coin-collection conduits into the coin return shaft.

It is also apparent from FIG. 2 that return knob 72 can only be actuated when control strip 80 is in its upper position. As soon as control strip 80 is moved doward by means of lever 78, shoulder 96 of control strip 80 covers return knob 82, which excludes a tilting of coin-checking plate 94 and therewith a concomitant release of the coin return.

An opening 71 in carrier plate 4, which opening can be rectangular, makes it possible for the coins, which fall verticaly down when the machine is opened, to exit. Coin catch bolts 97 keep the falling coins from getting into the return shaft when the machine is opened, and instead lets them fall right into the proper coin collection conduits.

FIGS. 3 to 8 show another embodiment of a coin machine in accordance with the invention. This embodiment comprises a housing with a front wall 215, a back wall and two side walls 244. A hole is located in the upper section of each side wall 244, through which an axle (not shown) is inserted to which an adjustment plate or coin setting plate 201 and a coin ejector 233 are pivotably fastened. Front wall 215 is preferably somewhat inclined. Front wall 215 also has two holes 216 in its upper section for suspending a coin-conduit plate 245. Plate 245 has two backwardly curved hooks on its upper edge which go through holes 216.

Since coin conduit plate 245 is suspended by the hooks, it can be pivoted out a little away from the front wall 215.

Figure 3:
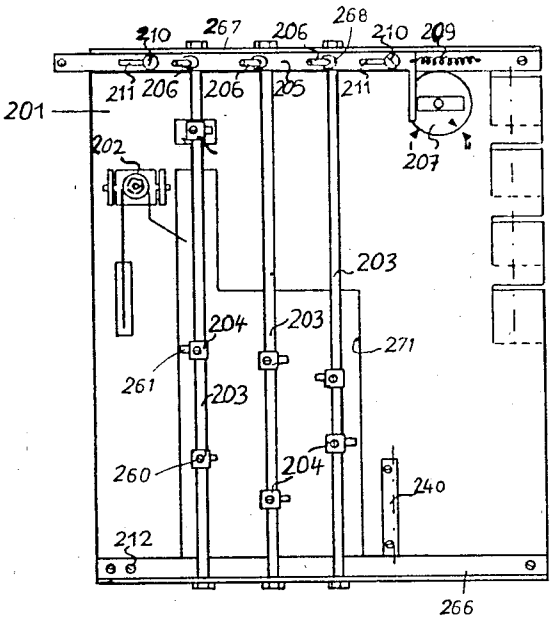
FIG. 3 shows another example of a coin adjustment plate of a coin mechanism with guide rods, the adjustment bushings which slide on them, and the price conversion strip.

Coin conduit plate 245 is followed by the so-called coin setting plage 201 which is shown in FIG. 3. Coin-setting plate 201 can also be pivoted away from front wall 215.

Figure 7:
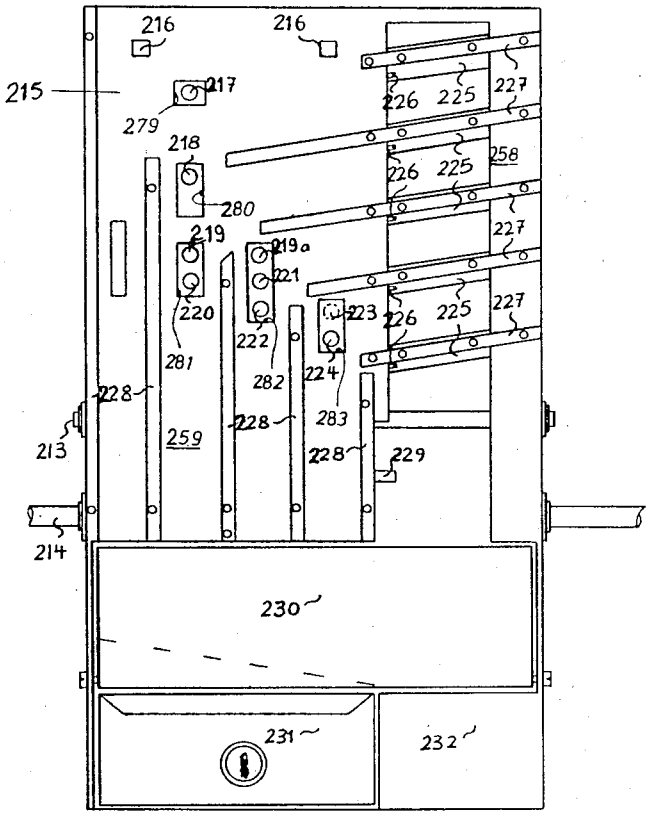
FIG. 7 is a front view of the housing, illustrating the inclined guide conduits and the vertical coin collection conduits.

As shown in FIG. 7, coin guide strips 227 are parallelly located at an interval from each other and inclined slightly downward on the front side of housing wall 215. Inclined guide conduits or coin-guide conduits 258 are thus formed between coin guide strips 227. Coin conduit strips 228 are mounted vertically on front wall 215, forming vertical coin collection conduits 259 between themselves. Each of these coin collection conduits come together with an associated, guided coin guide conduit 258. Guide conduits 258 in conjunction with vertical coin collection conduits 259 establish the path of the coins from the insert slot to the end of the coin-collection conduits. In the first part of the path, namely in the inclined guide conduits, the coins are checked for size. The coin checking plates 225, which are adjustably screwed onto the back side of the coin checking strips 227 overbridging the recesses, are set so that the coin in question barely extends over the lower edge of the coin checking plate. Smaller coins no longer reach this edge and fall over into the recesses. Larger coins are held by a nose 226 on the coin checking strip. In both instances the coin is rejected by coin ejector 233 when a return knob is actuated and falls between housing wall 215 and coin setting plate 201 down into coin return 232. Acceptable coins roll into the coin collection conduits 259 provided for them which are formed by front housing wall 215, coin conduit strips 228 and coin conduit plates 245.

The function of the coin mechanism is to free an operating shaft 214 so that it can rotate when the required number of coins are present, and on the other hand to block this shaft if the required number of coins is lacking. Blocking the shaft is effected by a clocking device. Blocking devices, formed by catch lever bolts 217, 218, 219, 220, 221, 223 and 224 in the vicinity of the conduits, are located in the vicinity of the transition of the inclined guide conduits 258 to the vertical coin collection conduits 259. These blocking devices or catch lever bolts are fixed to a blocking mechanism. The blocking mechanism is operatively connected for its part to the operating (service) shaft for releasing or not releasing the goods to be dispensed.

Figure 8:
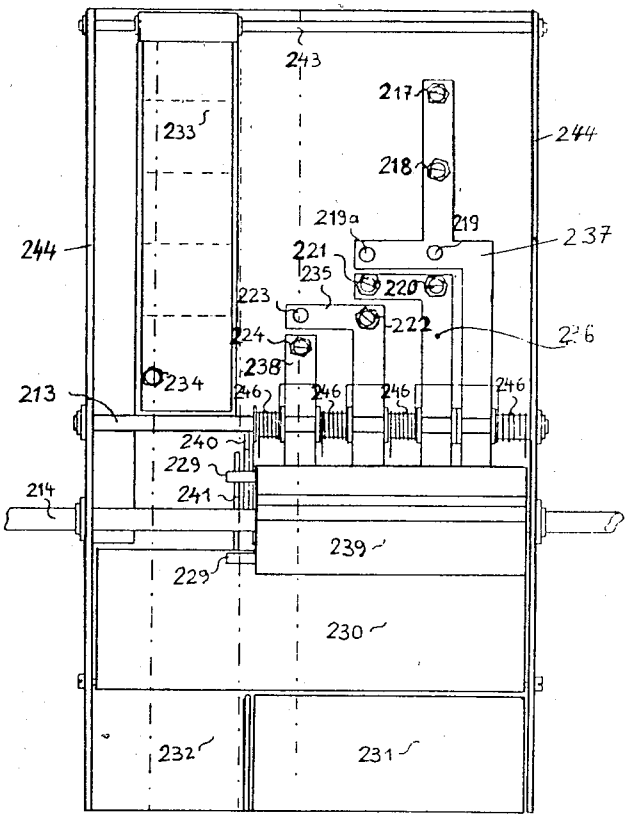
FIG. 8 is the back view of the housing of FIG. 3, illustrating the catch levers and the rotary cylinder which cooperates with the ends of the catch levers and for representing the coin ejector.

As shown in FIG. 8, the blocking mechanism consists of a rotary cylinder (feeder sleeve) 239 set on operating shaft 214. Feeder sleeve 239 has recesses (not shown) running along two generatrices which recesses are mutually staggered by 180°. Above feeder sleeve 239, catch levers 235, 236, 237 and 238 are pivotably arranged about an axle 213 held by its ends in side walls 244. These catch levers are pressed into a preferred position by catch lever springs 246 resting on axle 213, whereby the catch levers rest with their lower ends on the jacket surface of feeder sleeve 239 and engage into the recesses of the feeder sleeve when it rotates.

Feeder sleeve 239 can only be turned in one preferred direction via operating shaft 214. In the other direction of rotation feeder sleever 239, operating shaft 214 is blocked by the engaged ends of the catch levers. The blocking devices or catch bolts 217, 218, 219, 220, 221, 222, 223 and 224 are preferably located on the upper ends of catch levers 235, 236, 237, 238. When the lower end of the catch lever engages, the catch lever bolts more through openings 280, 281, 282, 283 in front housing wall 215. However, if there is a coin or a holding bolt 261, 265 of a coin setting casing 204 at this spot, the corresponding bolt of the catch lever is retained and the lower end of the catch lever is prevented from engaging into the recess of feeder sleeve 239. In this manner, operating shaft 214 can now be rotated clockwise or to the right.

FIG. 3 shows the coin setting late together with guide rods and setting casings, which set the required number of coins. Coin setting plate 201 is a level, rectangular plate with an opening 271 in its center. Two angular rails 266, 267 run along the upper and the lower edge of coin setting plate 201 which have bores in the one shank in which guide rods 203 are rotatably held vertically and parallel to each other. Coin settings casings 204 can be veretically shifted on guide rods 203. These casings can be screwed fast at the spot determined for the required number of coins by means of adjusting screw 260. Each setting casing has at least one holding bolt 261, but preferably two holding bolts 261 and 265. The position of holding bolt 261 of setting casing 204 is to be selected so that the uppermost of the required number of coins covers the particular bolt of the associated catch lever. Catch levers 236 and 235 each have an additional bolt 221, 223, respectively, which probes the adjacent coin conduit to the right (FIGS. 7, 8). This arrangement makes possible the selective insertion of different types of coins in order to pay the required price, e.g., five 0.10 DM coins instead of a 0.50 DM coin. In this case, the coin holder bolts 217, 218, 219, 220 of setting casing 204 associated with the 0.40 DM coin conduit must be set so that the 0.50 DM coin covers both catch bolts 221, 222. This procedure should always be followed when a selective insertion of two coin types in adjacent conduits is desired. However, if it is necessary that coins of both coin types must be present in adjacent conduits in order to pay the required price, the setting in the right conduit of the two adjacent conduits should be performed in such a way that the upper coin covers only the lower of the two catch lever bolts 221, 222.

A rocker 202 (FIG. 5) is located over the two coin conduits on the left side in FIG. 3, This rocker consists of a small plate 262 which is rotatably mounted in a holder and has a short lever 263 and a long lever 264. This rocker makes it possible to increase the number of selective possibilities of inserting two different coin values with a face value relationship of 1:2, e.g., 0.10 DM and 0.05 DM coins. The upper coin conduit provided for the infeed of the coin with the smaller face value is interrupted over the conduit for the coin with the greater face value, so that the first coin falls down here already. However, the shorter lever 263 or rocker 202 catches the coin. When a second coin of the lower face value is inserted, it rolls over the first one and falls into the next coin conduit. When the coin falls, it raises the longer lever 264 of rocker 202 and causes the shorter rocker lever 263 to rise at the same time, thus causing the first coin to fall into the coin conduit provided for the coin with the higher face value.

The catch lever bolts which are not used in any particular price setting are covered by corresponding bolts 265 (FIG. 6) of setting casings 204. Two setting casings 204 are associated with each coin conduit. This makes it possible to switch rapidly from one price to the other for the item to be dispensed.

This rapid switching feature consists of a price-switching strip 205 moveably mounted in the upper angular rail 267 by two holding bolts 210 which slide in slots 211. A return spring 209 is provided to force the price-switching strip into a rest position. The price-switching strip has an arm which contacts rotary knob 207 with two switch positions which is rotatably fixed to setting plate 201. Switching strip 205 has bores 268 at the intervals of the guide rods through which pins 206 extend which are fastened to guide bars 203. When rotary knob 27 is turned, switching strip 205 is moved to the left counter to the force of spring 209 (FIG. 7). This causes all guide bars 203 to be rotated clockwise by 90° due to pins 206 in bores 268. This causes the bolts 261 of a first set of the setting casings 204 set a first price to leave the coin conduits by rotating price-switching knob 207, and the bolts 265 of the second set of setting casings 204 set at a second price turn into the coin conduits. Such a rapid shifting is necessary, for example, in newspaper dispensing apparatus for switching from the daily price to the Sunday price. Depending on the position of the setting casings 204 when screwed fast by setting screw 260, the coin conduit can either be freed by the bolt during switching or reciprocally occupied by a second bolt. The latter mode of operation is required if the number of required coins in the particular coin conduit does not change, e.g., in a switch from 0.40 DM to 1.40 DM. Here, a change is necessary only for the 1.00 DM conduit, but not for the 0.10 DM coin conduit.

After the required number and type of acceptable coins have been inserted, operating (service) shaft 214 can be turned to the right by means of a rotary knob located outside of the coin machine. During the rotation of 180°, bolt 229 of feeder sleeve 239 first presses coin return flap 230 over rod 241 associated with it and then presses coin setting plate 201 away from front housing wall 215. The coins freed by this maneuver then fall down over the back wall of the coin return flap 230 into box 231 (FIG. 8). Operating shaft 214 can be turned to the right by 180° until catch levers 235, 236, 237 and 238 engage into the next of the two recesses of feeder sleeve 239.

The coin machine is operated by transferring the rotary movement of the operating shaft 214 to the particular vending mechanism used. This can be accomplished by means of mechanical levers, rods, V-belts, cable disks or similar mechanical elements.

The vending mechanism, however, can also be regulated by an electromotor. For this purpose, for example, feeder sleeve 239 can have two control magnets or two optosensors which feed the corresponding electrical impulses to the control of the electrically-operated vending device.

The above references to front, back, side and rear in describing relationships of various elements is for purposes of more easily describing the embodiments of the invention and are not intended to limit the scope of the invention as set forth in the claims hereto.

I claim:

1. A coin-operated dispensing machine for newspaper, magazine, food or other item comprising:

(a) a housing with front and rear walls and a vertical carrier plate located between the housing front and rear walls;

(b) a coin mechanism means for receiving and checking different types of coins and for releasing the dispensing machine when the correct coins for the item sales price have been inserted, the coin mechanism means including (i) at least one coin-checking plate arranged on the vertical carrier plate in a parallel plane to the carrier plate and having a coin-checking device for checking different types of coins;

(ii) coin-collecting conduit means for holding and releasing inserted coins received from said coin-checking plate, the coin-collecting conduit means including a coin-conduit plate parallel to the carrier plate for forming the side walls of coin-collecting conduits, connecting with the coin-checking plate, and having inclined slots, and a lower plate having inclined angular projections extending through said inclined slots for forming the bottoms of the coin-collecting conduits defined between the coin-conduit plate and carrier plate, said lower plate also being parallel to the carrier plate and being pivotal about an axis so that the angular projections can be tilted out of the inclined slots of the coin-conduit plate for releasing coins positioned in the coin conduits; and (iii) sensing and blocking mechanism means for sensing coins positioned in the coin-collecting conduits and controlling the opening of the dispensing machine, the sensing and blocking mechanism means including a moveable control mechanism for controlling opening of the dispensing machine, a blocking mechanism for releasing or blocking movement of the control mechanism, and a plurality of pivotable and vertically arranged spring-loaded sensor levers with sensor bolts located thereon for extending through the inclined slots of the coin-conduit plate in the absence of coins or engaging coins positioned in the coin-collecting conduits, said spring-loaded levers acting on said blocking mechanism in accordance with the coins sensed in the coin-collecting conduits for releasing or blocking movement of the control strip.

2. The coin-operated dispensing machine according to claim 1, wherein a coin-checking plate is arranged on both sides of the carrier plate, each coin-checking plate containing two coin-checking devices placed one above the other and displaced laterally.

3. The coin-operated dispensing machine according to claim 1, wherein the sensing and blocking mechanism means further comprises blocking rods located on said blocking levers and discs rotatable about an axle corresponding respectively to said blocking rods, the discs in certain positions blocking the respective blocking rods, and thereby the corresponding blocking levers.

4. The coin-operated dispensing machine according to claim 3, further comprising means accessible from the outside of the coin machine for adjusting the discs.

5. The coin-operated dispensing machine according to claim 4, wherein the disc adjusting means comprises a lock with a lock cyliner, a rotating round rod connected to the lock cylinder, and a connecting strip coupled to the rod and to the discs.

6. The coin-operated dispensing machine according to claim 1, wherein the blocking mechanism means comprises a blocking lever located adjacent the inside of the housing front wall and having an outwardly opening notch, and the control mechanism comprises a control strip moveably located on the inside of the housing front wall and having a bolt for latching into the outwardly opening notch for the blocking lever in the absence of coins sensed by the sensor levers in the coin-conduits.

7. The coin-operated dispensing machine according to claim 6, wherein the control strip has a bolt for engaging the lower plate when the control strip moves from a normal position to a position for opening the dispensing machine, thereby resulting in the removal of the bottoms of the coin-collecting conduits from the inclined slots of the coin-conduit plates and release of the coins in the coin-collecting conduits.

8. The coin-operated dispensing machine according to claim 1, 4 or 5, further comprising frames selectively moveable into different positions in relationship to the coin-collecting conduits in order to adjust for different coin values and a plurality of stopping bolts located on said frames for reaching into the coin-collecting conduits through the inclined slots of the coin-conduit plate and, thereby, into the path of the coins to be received in the coin-collecting conduits.

9. The coin-operated dispensing machine according to claim 6, further comprising a return knob for returning inserted coins and wherein the control strip has a shoulder which, starting with a predetermined position of the control strip, blocks the return knob.

10. The coin-operated dispensing machine according to claim 1, further comprising a handle for actuating the control strip outside the coin machine when the proper coins are inserted and sensed, said handle having an inclined lever extending through the control strip and moving the control strip when the handle is moved.

11. The coin-operated dispensing machine according to claim 1, wherein the coin mechanism means further comprises a pivotably-mounted rocker bracket for receiving coins from a coin-checking device of the coin-checking plate and comprises a rotatable lever, the rotatable lever including a first lever arm and a second lever arm, wherein at least one of the lever arms is directed downward toward an adjacent coin-collecting conduit.

12. The coin-operated dispensing machine according to claim 11, wherein the coin-checking plate has first and second coin-checking devices for respectively receiving coins of different values, and wherein the rocker bracket receives coins of similar value from the first coin-checking device.

13. The coin-operated dispensing machine according to claim 12, wherein the coin-conduit plate forms first and second coin-collecting conduits, with the first and second coin-collecting conduits receiving coins from said first coin-checking device via the rocker bracket and the first coin-collecting conduit receiving coins from the second coin-checking device.

14. The coin-operated dispensing machine according to claim 12, wherein coins received in the first coin-collecting conduit are sensed by the sensing levers and the coins received in the second coin-collecting conduit are not sensed by the sensing levers.

15. The coin-operated dispensing machine according to claim 14, wherein one of the lever arms of the rocker bracket temporarily retains the first coin received from the first coin-checking device and wherein the second coin of the same value received by the rocket bracket from the first coin-checking device releases the first coin from the rocker bracket, the first coin thereby being sent to the first coin-collecting conduit and the second coin of the same value being sent to the second coin-collecting conduit.

16. The coin-operated dispensing machine according to claim 14, wherein the coin-checking plate comprising the first and second coin-checking devices and rocker bracket and the corresponding coin-conduit plate forming the first and second coin-collecting conduits are arranged on both sides of the carrier plate for receiving coins of four different values.

* * * * *